US009707423B2

(12) United States Patent
Wagner

(10) Patent No.: US 9,707,423 B2
(45) Date of Patent: Jul. 18, 2017

(54) METHOD FOR EXTINGUISHING A FIRE IN AN ENCLOSED SPACE, AND FIRE EXTINGUISHING SYSTEM

(71) Applicant: Amrona AG, Zug (CH)

(72) Inventor: Ernst-Werner Wagner, Winsen (DE)

(73) Assignee: AMRONA AG, Zug (CH)

( * ) Notice: Subject to any disclaimer, the term of this patent is extended or adjusted under 35 U.S.C. 154(b) by 0 days.

(21) Appl. No.: 14/360,757

(22) PCT Filed: Oct. 16, 2012

(86) PCT No.: PCT/EP2012/070483

§ 371 (c)(1),
(2) Date: May 27, 2014

(87) PCT Pub. No.: WO2013/083324

PCT Pub. Date: Jun. 13, 2013

(65) Prior Publication Data

US 2014/0345885 A1 Nov. 27, 2014

(30) Foreign Application Priority Data

Dec. 5, 2011 (EP) ..... 11191891

(51) Int. Cl.
*A62C 2/00* (2006.01)
*A62C 37/36* (2006.01)
(Continued)

(52) U.S. Cl.
CPC ..... *A62C 37/04* (2013.01); *A62C 35/68* (2013.01); *A62C 99/0018* (2013.01)

(58) Field of Classification Search
CPC ..... A62C 37/04
(Continued)

(56) References Cited

U.S. PATENT DOCUMENTS 4,091,874 A 5/1978 Monma
5,918,680 A * 7/1999 Maranghides ..... A62C 99/0018 169/16
(Continued)

FOREIGN PATENT DOCUMENTS

CN 1533814 10/2004
DE 198 11 851 A1 9/1999
(Continued)

OTHER PUBLICATIONS

National Fire Protection Association 2001, Standard on Clean Agent Fire Extinguishing Systems, 2008 edition.*
(Continued)

*Primary Examiner* — Arthur O Hall
*Assistant Examiner* — Adam J Rogers
(74) *Attorney, Agent, or Firm* — Cesari and McKenna, LLP

(57) ABSTRACT

The present invention relates to a system as well as a method for extinguishing fire in an enclosed room (6) in which the enclosed room (6) is flooded with extinguishing gas at least until an extinguishing gas concentration capable of providing an extinguishing effect (a) is set in the flood zone. In order to achieve the realizing of a maximum extinguishing gas concentration (b) as quickly as possible without the flooding of the room (6) thereby posing a danger to people, it is inventively provided for the flooding of the enclosed room (6) to be divided into a pre-flooding phase and a main flooding phase subsequent thereto. The pre-flooding phase corresponds to an interval of time between the time ($t_1$) the alarming starts to warn people of impending danger and a predefined time ($t_2$). The main flooding phase corresponds to an interval of time between the predefined time ($t_2$) and the time ($t_4$) at which a maximum extinguishing gas concentration (b) is reached. The enclosed room (6) is flooded such
(Continued)

Figure 1A:
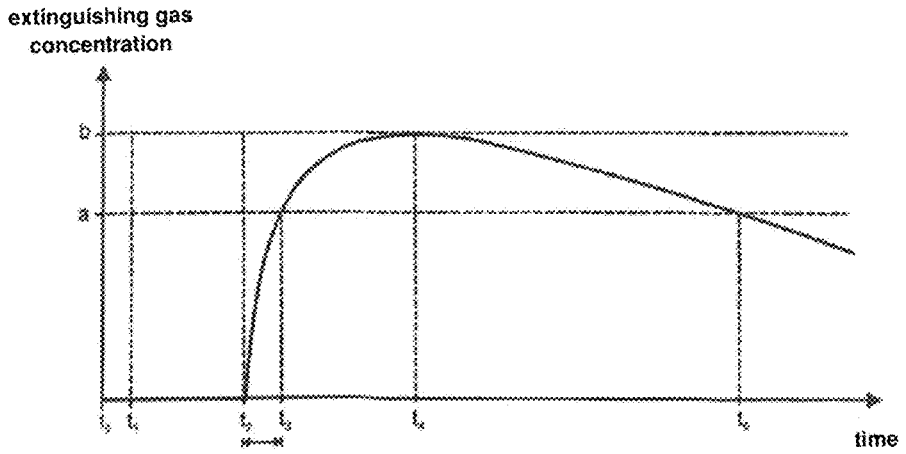
Fig. 1a (prior art)

that during the entire pre-flooding phase, the concentration of extinguishing gas in the enclosed room (6) does not exceed a predefined or predefinable value for the extinguishing gas employed which is below the critical NOAEL value.

10 Claims, 7 Drawing Sheets

(51) Int. Cl.
*A62C 99/00* (2010.01)
*A62C 35/68* (2006.01)

(58) Field of Classification Search
USPC ..... 169/46
See application file for complete search history.

(56) References Cited

U.S. PATENT DOCUMENTS

| | | | | |
|---|---|---|---|---|
| 6,952,169 | B1 * | 10/2005 | Simtion | A62C 37/44 169/60 |
| 2007/0044979 | A1 * | 3/2007 | Popp | A62C 37/44 169/60 |
| 2008/0087445 | A1 * | 4/2008 | Wagner | A62C 99/0018 169/45 |

FOREIGN PATENT DOCUMENTS

| | | | | |
|---|---|---|---|---|
| EP | 1 911 498 | A1 | 4/2008 | |
| EP | 2 186 546 | A1 | 5/2010 | |
| GB | 2386835 | A * | 10/2003 | A62C 5/00 |
| JP | H09 206399 | A | 8/1997 | |

OTHER PUBLICATIONS

Translation of International Preliminary Report on Patentability mail date Feb. 28, 2014 for International Patent Application No. PCT/EP2012/070483 filed on Oct. 16, 2012 by Amrona AG, 7 pages.

International Search Report and Written Opinion mail date Apr. 9, 2013 for International Patent Application No. PCT/EP2012/070483 filed on Oct. 16, 2012 by Amrona AG, 9 pages.

International Preliminary Report on Patentability mail date Feb. 28, 2014 for International Patent Application No. PCT/EP2012/070483 filed on Oct. 16, 2012 by Amrona AG, 19 pages.

Examination Report mail date Oct. 21, 2013 for European Patent Application No. 11 191 891.8-1659, filed on Dec. 5, 2011 by Amrona AG, 4 pages.

* cited by examiner

METHOD FOR EXTINGUISHING A FIRE IN AN ENCLOSED SPACE, AND FIRE EXTINGUISHING SYSTEM

RELATED APPLICATIONS

The present application is a 371 of International Application No. PCT/EP2012/070483 filed Oct. 16, 2012 by Amrona AG for a METHOD FOR EXTINGUISHING A FIRE IN AN ENCLOSED SPACE, AND FIRE EXTINGUISHING SYSTEM and claims priority to European Patent Application No. 11191891.8 filed Dec. 5, 2011, by Amrona AG for a Method for extinguishing a fire in a closed space and fire extinguishing assembly, both of which are hereby incorporated by reference in their entirety.

The present invention relates to a method for extinguishing fire in an enclosed room in which the enclosed room is flooded with extinguishing gas at least until an extinguishing gas concentration capable of providing an extinguishing effect is reached in the flood zone. The invention further relates to a fire extinguishing system for extinguishing fire in an enclosed room by flooding the enclosed room with an extinguishing gas in a regulated manner, wherein the fire extinguishing system comprises at least one source of extinguishing gas for supplying an extinguishing gas, an extinguishing gas supply line system via which the extinguishing gas provided by the at least one extinguishing gas source can be supplied to the enclosed room, and a control unit for setting the amount of extinguishing gas supplied to the enclosed room per unit of time.

The principle of such fire extinguishing systems is known from the prior art and essentially consists of at least one extinguishing gas cylinder having a supply of extinguishing agent stored in gaseous, pressurized, liquefied form or stored in liquid form with a pressure pad, the necessary valves, and a pipeline system with nozzles appropriately distributed within the protected zone (enclosed room).

Employed in such fire extinguishing systems as gaseous extinguishing agents, which are also referred to as "extinguishing gas" herein, are for example oxygen-displacing gases such as carbon dioxide, nitrogen, noble gases (e.g. argon) and mixtures thereof (e.g. Argonite, Inergen). Such extinguishing gases extinguish fires by essentially displacing the atmospheric oxygen from the site of the fire. Halogenated hydrocarbons (e.g. HFC227ea and FK-5-1-12) are likewise used as extinguishing agents in fire extinguishing systems. The extinguishing effect of these extinguishing gases is based on a chemical/physical principle.

It is advantageous for gaseous extinguishing agents to quickly and uniformly permeate the flood zone so that a protective effect is afforded throughout the space within the shortest possible time. After effective extinguishing, it can be necessary, in order to prevent flare-ups, to maintain the extinguishing gas concentration until hot surfaces cool down enough so that deep-seated fires will be extinguished or components supplied electrical energy can be disconnected.

Depending on the materials to be extinguished (fire load) and the extinguishing gases used, varying high concentrations of extinguishing gas as well as varying high concentrations of oxygen can be used when fighting fire. These varying concentration levels also pose varying risks to people who may be within the hazard zone (enclosed room).

The following table compiles example toxicity parameters for various extinguishing gases currently used in fire extinguishing systems. These toxicity parameters establish at which hazard class the fire extinguishing system is to be classified. A differentiation is hereby made between the following four hazard classes:

Class I: Extinguishing gas concentration up to NOAEL (extinguishing gas concentration≤NOAEL) and oxygen concentration above 12% by volume ($[O_2]$≥12 vol %);

Class II: Extinguishing gas concentration between NOAEL and LOAEL (NOAEL<extinguishing gas concentration≤LOAEL) and oxygen concentration above 10% by volume ($[O_2]$≥10 vol %);

Class III: Extinguishing gas concentration above LOAEL and below life-threatening concentration (LOAEL<extinguishing gas concentration<LTC) and oxygen concentration above 8% by volume ($[O_2]$≥8 vol %); and Class IV: Extinguishing gas concentration at and above life-threatening concentration (extinguishing gas concentration≥LTC) and/or oxygen concentration below 8% by volume ($[O_2]$<8 vol %);

| Extinguishing gas | NOAEL in vol % extinguishing gas | LOAEL in vol % extinguishing gas | LTC in vol % extinguishing gas | Density at 20° C. and 1013 mbar |
|---|---|---|---|---|
| $CO_2$ | 5.0 | 5.0 | 5.0 | 1.84 kg/m$^3$ |
| IG-O1 (argon) | 43.0 | 52.0 | 62.0 | 1.662 kg/m$^3$ |
| IG-100 (nitrogen) | 43.0 | 52.0 | 62.0 | 1.165 kg/m$^3$ |
| IG-541 | 43.0 | 52.0 | 62.0 | 1.418 kg/m$^3$ |
| IG-55 | 43.0 | 52.0 | 62.0 | 1.412 kg/m$^3$ |
| HFC227ea | 9.0 | 10.5 | 12 | 7.283 kg/m$^3$ |
| FK-5-1-12 | 10.0 | n/a | n/a | 13.908 kg/m$^3$ |

The term "NOAEL" (abbreviation for "no-observed-adverse-effect level") hereby designates the highest concentration of extinguishing gas in percent by volume at which no adverse health effects can be determined. The term "LOAEL" (abbreviation for "lowest observed adverse effect level") designates the lowest concentration of extinguishing gas in percent by volume at which adverse health effects can be determined. LTC stands for "life-threatening concentration" and indicates the lowest concentration of extinguishing gas to pose acute mortal danger even for a brief period of time.

For example, if carbon dioxide is used as extinguishing gas, damage to health can be expected as of a concentration of 5 vol % $CO_2$ and mortal danger threatens as of a concentration of 8 vol % $CO_2$. The extinguishing effect of $CO_2$ is mainly based on decreasing the oxygen content of the air to a level which suppresses the combustion process.

The volume of extinguishing gas required for an individual flood zone so as to protect the area and equipment depends on the one hand on the extinguishing gas that will be used and, on the other, on the incendiary matter; i.e. the substances which have or can catch fire. The table below indicates example concentrations of extinguishing gas and oxygen which are effective in extinguishing fire in various facilities when carbon dioxide is used as the extinguishing gas.

| Facility | $CO_2$ vol % concentration within 4 min | $O_2$ vol % concentration within 4 min | $CO_2$ vol % concentration within 1 min | $O_2$ vol % concentration within 1 min |
|---|---|---|---|---|
| Electrical switching and distribution cabinets | 40 | 12.6 | 34 | 13.8 |
| Electronic data processing equipment | 61 | 8.2 | 34 | 13.8 |
| IT rooms (machine rooms) | 47 | 11.2 | 34 | 13.8 |
| high-bay racking ID and checkpoint | 47 | 11.2 | 34 | 13.8 |
| Generators incl. cooling system | 57 | 9.1 | 34 | 13.8 |
| Cable rooms, floors and ducts | 47 | 11.2 | 34 | 13.8 |

Therefore—depending on the extinguishing gas to be used and the incendiary matter in the enclosed room—the required extinguishing gas concentration for a sufficient extinguishing effect can potentially be life-threatening for any people who may be in the extinguishing zone. Appropriate safety precautions must be taken with these fire extinguishing systems so as to be able to immediately evacuate the hazardous areas in the event of a fire and prior to the flood of extinguishing gas and to prevent people from entering after the extinguishing gas has been released. Accordingly, pursuant the VdS 3518 Guidelines (July 2006) and the BGI 888 (January 2004), alarm systems and delay mechanisms with sufficient time delay also need to be provided in at-risk personnel-occupied areas which allow the protected area to be exited without undue haste. Viable alarm systems include acoustic and, where appropriate, visual mechanisms to ensure the appropriate alerting and warning of any people who may be within the extinguishing/hazard zone in the event of a fire.

Fire extinguishing systems which pose a danger to people by the flooding of the extinguishing zone additionally need to be equipped with so-called delay mechanisms. Depending on the fire extinguishing system's hazard class, electric or non-electric; i.e. mechanical or pneumatic delay mechanisms can be employed. Delay mechanisms are to ensure that a flooding of the extinguishing zone will not occur until after the alarm mechanisms have been set off and a set advance warning period has passed. The set advance warning period needs to be calculated such that all potentially occupied sites within the extinguishing/hazard zone can be exited without haste. According to the VdS 3518 Guidelines (July 2006) and the BGI 888 (January 2004), the advance warning period must be at least 10 seconds. Therefore, fire extinguishing systems must enable a hazard class-dependent time-delayed flooding with advance warning period. The advance warning period must be operative upon each automatic or manual activating of the fire extinguishing system.

Figure 1B:
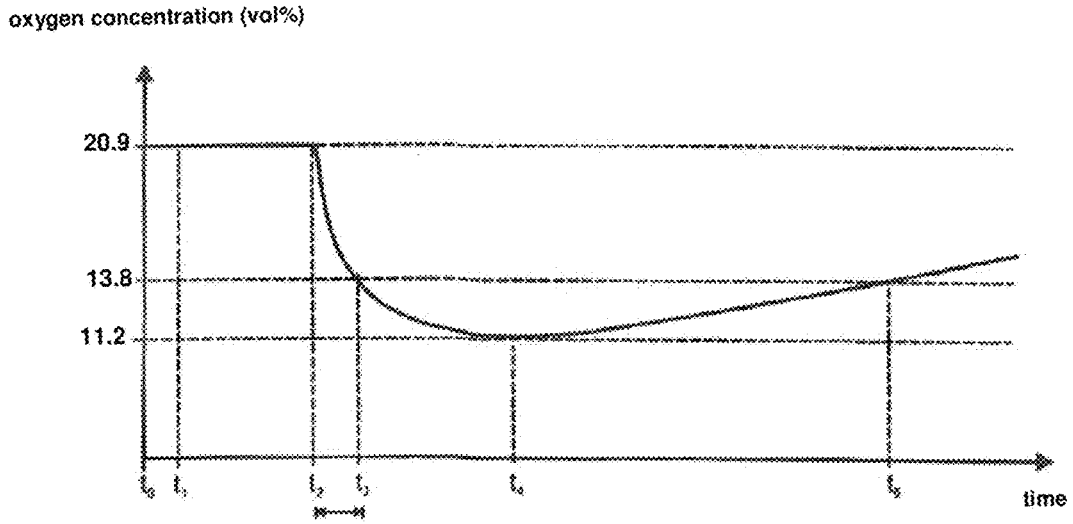
Fig. 1b (prior art)

FIG. 1*a* shows the temporal gradient of extinguishing agent concentration in prior art fire extinguishing systems with effective advance warning period. FIG. 1*b* correspondingly depicts the change in the oxygen concentration over time in the extinguishing zone.

FIGS. 1*a* and 1*b* depict time t0, the instant at which a fire is detected in the extinguishing zone. The t0-t1 interval expresses the system-dependent delay time of the fire extinguishing system. In the absence of a delay mechanism, time t1 would be the instant at which flooding would begin; i.e. the extinguishing gas actually being introduced into the enclosed room. Since—as explained above—there needs to be a time-delayed flooding with an advance warning period so as to protect personnel, extinguishing gas is not yet flowing into the enclosed room at time t1.

The t1-t2 interval indicates the set advance warning period; i.e. the time between the start of the alarm at time t1 and the start of extinguishing gas release. The advance warning period must last at least 10 seconds, however must not be longer than the time required for safe evacuation. The gaseous extinguishing agent is released at time t2, in consequence of which the concentration of extinguishing gas in the enclosed room's spatial atmosphere rises steadily and the oxygen concentration decreases accordingly. The concentration a capable of providing an extinguishing effect is reached at time t3. This concentration of extinguishing gas capable of providing an extinguishing effect is also known as "design concentration" in fire protection technology.

The accumulative flooding of the enclosed area ends at time t4, namely when the maximum concentration of extinguishing gas has been reached in the enclosed room. The t2-t3 interval accordingly indicates the accumulative period for the concentration of extinguishing gas capable of providing an extinguishing effect and the t2-t4 interval the entire accumulative flooding period. When—as depicted in FIGS. 1 and 2—no sustained flooding occurs after the accumulative flooding ceases at time t4; i.e. a subsequent flooding by means of which the concentration of extinguishing gas capable of providing an extinguishing effect is maintained in the flood zone for a longer period of time, the concentration of extinguishing gas then decreases in the enclosed room due to leakages in the room's spatial shell until it ultimately falls below the concentration capable of providing an extinguishing effect at time t6.

On the other hand, according to the VdS 2380 and VdS 2381/VdS 2093 Guidelines, fire extinguishing systems which make use of a gaseous extinguishing agent need to be dimensioned such that the concentration of extinguishing gas capable of providing an extinguishing effect is established throughout the entire enclosed room in the extinguishing zone within 10, 60 or 120 seconds after the extinguishing agent has been released. This requirement can be only met with correspondingly large-dimensioned fire extinguishing systems. Therefore, in the case of large rooms such as for example warehouses, etc., relatively high capital investments need to be made when realizing fire extinguishing systems with gaseous fire extinguishing agents as room safety systems.

Based on this problem as posed, the present invention addresses the objective of further developing a method and a respective fire extinguishing system of the type cited at the outset to the effect of being able to increase the effective time given to building up the concentration of extinguishing gas able to provide an extinguishing effect without thereby endangering any persons who may be in the enclosed room.

With respect to the method, the invention accomplishes this objective with a visual and/or acoustic alarm mechanism triggering a warning to any persons who might be within the enclosed area that release of an extinguishing agent will be initiated such that an extinguishing gas will be fed into the enclosed room during a pre-flooding phase, wherein the pre-flooding phase corresponds to an interval of time between the instant the extinguishing agent release begins and a predefined point in time, and with monitoring the status of the enclosed room, wherein during the initiating, the release of extinguishing agent floods the enclosed room such that the concentration of extinguishing gas in the enclosed room over the entire pre-flooding phase does not exceed a predefined or predefinable value below the critical NOAEL value for the extinguishing gas employed.

With respect to the fire extinguishing system, the objective on which the invention is based relative to a fire extinguishing system of the type specified at the outset is inventively accomplished by the control unit being designed to adjust the amount of extinguishing gas supplied to the enclosed room per unit of time in the event of fire such that the enclosed room is flooded after the occurrence of a predefined event, wherein during a pre-flooding phase lasting from an initial point in time up to a predefined point in time, the enclosed room is flooded such that the concentration of extinguishing gas in the enclosed room does not exceed a predefined or predefinable value for the extinguishing gas employed, and wherein a main flooding phase subsequent to or immediately after the pre-flooding phase floods the enclosed room such that the concentration of extinguishing gas reaches a maximum extinguishing gas concentration equal to or greater than the concentration of extinguishing gas capable of providing an extinguishing effect. The predefined or predefinable extinguishing gas concentration value which is not to be exceeded during the pre-flooding phase is thereby less than the NOAEL value for the extinguishing gas employed.

The advantages which can be attained with the inventive solution are obvious: By the invention dividing the interval between the point in time at which at least one alarm mechanism responds and the point in time of a maximum extinguishing gas concentration being reached into a pre-flooding phase and a main flooding phase, it is possible to already begin flooding the enclosed room at the point in time at which the alarm mechanism responds, wherein so as to protect personnel, however, the amount of extinguishing gas introduced into the enclosed room per unit of time during the advance warning period is selected so as to rule out any endangering of personnel. According to the invention, it is in particular provided for the extinguishing gas concentration in the enclosed room to not exceed a predefined or predefinable value for the extinguishing gas employed over the course of the entire pre-flooding phase, wherein the predefined or predefinable value is below the NOAEL value for the extinguishing gas employed.

The interval of time between the alarm mechanism response and the start of the main flooding phase corresponds to the usual advance warning period in fire protection technology and is calculated such that any given spot within the enclosed room can be exited without haste. Once the advance warning period passes; i.e. at the end of the pre-flooding phase, the so-called main flooding phase begins immediately, during which the enclosed room is flooded with extinguishing gas for as long as necessary to reach the maximum concentration of extinguishing gas. It can thus be established that, according to the inventive solution, the accumulative flooding is divided into a pre-flooding and a subsequent main flooding, wherein—in contrast to conventional fire extinguishing systems—accumulative flooding has already begun at the point in time at which the alarm mechanism responds.

Since the extinguishing gas is already flowing out into the enclosed room during the advance warning period and the flooding of the enclosed room thus begins immediately, the extinguishing gas concentration capable of providing an extinguishing effect can be reached in the enclosed room at an earlier point in time with the inventive solution than with conventional systems in which a delayed flooding with advance warning period occurs. The fire extinguishing system can thus be dimensioned smaller for a given room without running the risk of not being able to comply with the maximum 10, 60 or 120 second period specified in the VdS Guidelines for achieving the extinguishing gas concentration capable of providing an extinguishing effect.

On the other hand, the inventive solution enables a lesser amount of extinguishing gas introduced into the enclosed room per unit of time over the entire flooding period compared to fire extinguishing systems in which a time-delayed flooding occurs since there is more time to flood the room in the inventive solution. The inventive solution is accordingly particularly suited to applications seeking "temperate flooding" of an enclosed room. This is for example the case when the enclosed room is not or cannot be equipped with great enough pressure relief. In other words, the inventive solution allows a more temperate flooding so that the pressure relief flaps with which the enclosed room needs to be provided for the purpose of pressure relief and to prevent damage due to high excess pressure upon the introduction of the extinguishing gas can be of smaller dimensions. This also reduces the costs and the expenditure when a room is to be provided with a fire extinguishing system as a room protection system.

Advantageous further developments of the method and/or fire extinguishing system according to the invention are specified in the dependent claims.

With respect to the inventive method, it is preferential for the flooding to occur during the supply of the extinguishing gas into the enclosed room within the pre-flooding phase such that, at the latest at the predefined time, the extinguishing gas concentration in the enclosed room is at a predefined or predefinable value dependent on the fire load of the enclosed room. Doing so thereby ensures that effective firefighting occurs within the enclosed room, at the latest starting as of the predefined point in time.

It is further preferential for the point in time at which the extinguishing agent is released to initiate the pre-flooding phase to coincide with that point in time corresponding to the triggering of the visual and/or acoustic alarm mechanism. Doing so thereby in particular ensures the maximum possible amount of time to warn/alert the persons within the enclosed room while simultaneously building up the pre-flooding concentration. Simultaneously warning people and initiating the pre-flooding phase by introducing the extinguishing agent thus also wastes no time in terms of building up the total extinguishing agent concentration so as to yield effective firefighting.

It is also preferred for the predefined point in time defining the end of the pre-flooding phase and the beginning of the main flooding phase to be defined so as to correspond to the advance warning period specified in the VdS 3518 Guidelines (July 2006) or the BGI 888 (January 2004), thus to be calculated such that any people who may be within the enclosed room can exit the room from any given spot without haste. It is thus in particular preferential for the predefined time point to be selected such that the pre-flooding phase amounts to at least 10 seconds. This measure ensures the personnel safety stipulated by the VdS 3518 Guidelines (July 2006) and the BGI 888 (January 2004).

It is further preferential for the predefined or predefinable value for the concen-tration of extinguishing gas which is not to be exceeded with respect to the extin-guishing gas introduced over the entire pre-flooding phase to correspond to an oxygen concentration which still allows unrestricted accessibility.

To be understood by the term "unrestricted accessibility" as used herein is that as defined in the report from the Berufsgenossenschaft für Sicherheit and Gesundheit, Arbeitskreis "Feuerschutz" (Occupational Health and Safety Agency "Fire Protection" task force; January 2005). According thereto, persons may enter areas of reduced oxygen without respirators, etc. under the following conditions:

Category I area: (21 vol %>oxygen concentration≥17 vol %): All persons not suffering from coronary, circulatory, vascular or respiratory diseases can enter these areas.

Category II area: (17 vol %>oxygen concentration≥15 vol %): Persons entering these areas must undergo a medical exam prior to initial entry.

Category III area: (15 vol %>oxygen concentration≥13 vol %): Persons entering these areas may only perform light physical activities in said areas and must undergo a medical exam prior to initial entry.

Hence, in some circumstances, enclosed rooms having an oxygen concentration reduced down to 13% by volume may still be freely entered given certain pre-cautionary measures since the reduced oxygen content in principle poses no medical risk to people. Yet in some cases, national prescribed safety precautions may need to be observed in terms of unrestricted accessibility to oxygen-reduced areas. These safety precautions are specified in the respective national regula-tions and depend particularly on the reduced oxygen content level corresponding to the accessibility level.

It is noted that the inventive dividing of the period between alerting and the reaching of maximum extinguishing gas concentration into a pre-flooding phase and a subsequent main flooding phase does not necessarily entail an inflection in the flooding gradient; i.e. the temporal development of the extinguishing gas concentration in the enclosed room's atmosphere, at the start of the main flooding phase. Particularly in rooms of relatively small spatial volume, which can be the case for example with electrical switching and distribution cabinets, it is possible for the amount of extinguishing gas introduced into the enclosed room per unit of time during the pre-flooding phase to be equal to the amount of extinguishing gas introduced into the enclosed room per unit of time during the main flooding phase. In such a case, the extinguishing gas concentration continuously increases in the enclosed room's spatial atmosphere without any change to the flooding curve's gradient. In contrast to conventional fire extinguishing systems in which a time-delayed flooding occurs, the inventive solution is characterized by an overall more temperate flooding; i.e. a lesser amount of extinguishing gas is introduced into the enclosed room per unit of time than is the case in the conventional solutions. This in turn allows the enclosed room to be equipped with smaller-dimensioned pressure relief flaps.

Alternatively, however, to the above-cited embodiment in which the same amount of extinguishing gas is introduced into the enclosed room per unit of time during the pre-flooding phase and the main flooding phase, it is conceivable for the amount of extinguishing gas introduced into the enclosed room per unit of time during the pre-flooding phase to be less than the amount of extinguishing gas introduced during the main flooding phase. This embodiment is particularly applicable to large-volume rooms such as for example high-bay storage facilities. The technical effect achievable with the inventive solution, according to which there is more overall time to introduce extinguishing gas into the enclosed room by dividing the period between the alerting and the reaching of the maximum extinguishing gas concentration into a pre-flooding phase and a subsequent main flooding phase, is apparent in these cases.

One preferred realization of the inventive method provides for the extinguishing gas introduced into the enclosed room during the pre-flooding phase to have a different chemical composition than the chemical composition of the extinguishing gas introduced into the enclosed room during the main flooding phase. It is thus for example conceivable for an extinguishing gas or extinguishing gas mixture to be introduced into the enclosed room during the pre-flooding phase; i.e. that phase which corresponds to the advance warning period, within which persons who are within the enclosed room must exit the room, which has different toxicity properties compared to the extinguishing gas or extinguishing gas mixture introduced during the main flooding phase. It is particularly suitable to use an extinguishing gas with a relatively high NOAEL value during the pre-flooding phase in order to lower the potential risk to any people who may still be inside the enclosed room. This safety aspect no longer needs be heeded during the main flooding phase since this phase starts at a point in time at which it is ensured that no people are left within the enclosed room. It is thus for example conceivable to use nitrogen or argon or a gas mixture (of nitrogen, argon or $CO_2$) as the extinguishing gas during the pre-flooding phase whereas $CO_2$ extinguishing gas is used during the main flooding phase. As noted above, nitrogen or argon exhibits a critical NOAEL value of 43.0 whereas the NOAEL value for $CO_2$ is 5.0.

In conjunction hereto, it is nevertheless conceivable for the extinguishing gas introduced into the enclosed room during the pre-flooding phase to be nitrogen-enriched air produced directly on-site by means of a nitrogen generator. Since conventional nitrogen generators are normally not designed to furnish the required quantity of extinguishing gas; i.e. the amount of extinguishing gas required to reach the design concentration, within the shortest possible period of time, at least the extinguishing gas to be introduced into the enclosed room during the main flooding phase should be kept in store, for example in compressed gas cylinders.

One preferential further development of the inventive method provides for the extinguishing gas concentration in the enclosed room to be maintained at the predefined or predefinable value during a first sustained flooding phase after the status of the enclosed room has been checked, whereby the first sustained flooding phase corresponds to an interval of time between the time at which the pre-flooding phase ends and a predefined point in time or manually definable time. This further development thus provides for a first sustained flooding phase subsequent the pre-flooding phase, during which post-feeding of extinguishing gas, if need be regulated post-feeding of extinguishing gas, keeps the concentration of extinguishing gas in the enclosed room at a value below the critical NOAEL value for the extinguishing gas employed. The predefined or predefinable value at which the concentration of extinguishing gas is held during this first sustained flooding phase is preferably to be selected as a function of the fire load of the enclosed room. When a possible smaller fire or smaller hot spot has already been extinguished during the pre-flooding phase, this thereby ensures effective flare-up prevention such that objects in the room which possibly have hot surfaces and are susceptible to such reigniting are able to cool down during this first sustained flooding phase.

It is hereby particularly preferable to only maintain the concentration of extinguishing gas in the enclosed room at the predefined or predefinable value during the first sustained flooding phase when it can be verified during the process of monitoring the status of the enclosed room either automatically, particularly by means of at least one fire detector, and/or manually, particularly by actuation of a corresponding switch, that no fire is present in the enclosed room once the pre-flooding phase ends. It is then hereby to be ensured that the corresponding sustained flooding during the first sustained flooding phase only occur at the value below the critical NOAEL value for the extinguishing gas employed when there is no fire or no more fire in the enclosed room at the end of the pre-flooding phase. If fire is instead detected, the main extinguishing phase can further continue after the first sustained flooding phase. The point in time which marks the end of the first sustained flooding phase can hereby be predefined or subsequently manually definable.

It can further be provided during the process of monitoring the status of the enclosed room to detect and/or ensure either automatically, particularly by means of at least one fire detector, and/or manually, particularly by actuation of a corresponding switch, whether a fire which broke out in the enclosed room has not been or not been sufficiently suppressed once the pre-flooding phase ends. In this case, the inventive method comprises a further procedural step according to which by a release of extinguishing agent being initiated, the enclosed room is fed extin-guishing gas during a main flooding phase for as long as it takes the extinguishing gas concentration in the enclosed room to reach a predefined or predefinable target concentration, wherein the predefined or predefinable target concentration is at least equal to an extinguishing gas concentration dependent on the fire load of the enclosed room. The main flooding phase hereby corresponds to an interval of time between the predefined point in time marking the end of the pre-flooding phase and the point in time at which the target concentration is reached.

By automatically and/or manually verifying the continuing state of fire, thus the verification that a fire which broke out in the enclosed room has not been or not been sufficiently suppressed once the pre-flooding phase ends, a certain and in particular complete extinguishing of the fire can thereafter be achieved.

One preferential further development of the inventive method provides for extinguishing gas to continue to be fed in regulated manner to the enclosed room after the maximum extinguishing gas concentration has been reached at the end of the main flooding phase such that the extinguishing gas concentration in the enclosed room does not fall below the extinguishing gas concentration capable of providing an extinguishing effect dependent on the fire load of the enclosed room during a second sustained flooding phase, whereby the second sustained flooding phase corresponds to an interval between the point at which the main flooding phase ends and a predefined or a manually definable point in time.

This further development thus provides for a second sustained flooding phase immediately following the main flooding phase, during which the concentration of extinguishing gas in the enclosed room is always kept above the extinguishing gas concentration capable of providing an extinguishing effect by the regulated post-feeding of extinguishing gas. The sustained flooding period; i.e. the interval of time between the end of the accumulative flooding and the point in time of falling below the extinguishing gas concentration capable of providing an extinguishing effect (end of the sustained flooding) is preferably to be selected such that material in the enclosed room has sufficiently cooled or no more hot spots are present in order to effectively prevent re-ignition after dropping under the extinguishing gas concentration capable of providing an extinguishing effect. Depending on the fire load of the enclosed room; i.e. the flammability to the materials which can catch fire within the enclosed room, the sustained flooding period can last up to several minutes. Similar to the predefined or manually definable point in time for the end of the first sustained flooding phase, it is just as conceivable for the point in time for the end of the second sustained flooding phase to be manually defined. This can in particular occur in the form of manual resetting. In this case, the end of the second sustained flooding phase is then manually defined when it is for example determined that the materials within the enclosed room have sufficiently cooled.

In the latter embodiment cited in which a sustained flooding is provided after the accumulative flooding, it is conceivable for the extinguishing gas introduced into the enclosed room in regulated manner during the sustained flooding period to be provided by an inert gas generator. However, it is of course also conceivable for the extinguishing gas introduced into the enclosed room during the sustained flooding to be kept in store, for example in a compressed gas cylinder.

To be understood by the term "maximum extinguishing gas concentration" as used herein is the concentration of extinguishing gas which exists at the end of accumulative flooding in the enclosed room. For safety reasons, this maximum extinguishing gas concentration is at least as high as the so-called extinguishing gas concentration capable of providing an extinguishing effect which relates to the concentration of extinguishing gas necessary to successfully extinguish fire and which is called the "design concentration" in the field.

The visual and/or acoustic alarming mechanism is provided to ensure that any persons who may be inside the enclosed room will exit the hazard zone during the pre-flooding phase. The alarming mechanism, which is simultaneously triggered when the flooding of the enclosed room begins, therefore serves to warn any people there may possibly be within the enclosed room. It is hereby to be kept in mind that due to the specifics of the system itself, the start of the enclosed room flooding or the time at which the alarm starts respectively, is normally not the same exact time as when a fire detection device responds or a manual triggering is initiated respectively. There can be a system-dependent delay between this point in time and the beginning of flooding or time of alerting respectively, same related to the equipment itself and usually amounting to a few milliseconds to seconds.

So as to be able to detect an outbreak of fire or combustion in the enclosed room as early as possible, one preferred further development of the inventive solution provides for monitoring the enclosed room preferably continuously or at predeter-mined times or upon predetermined events with respect to the presence of at least one fire characteristic, wherein the flooding of the enclosed room with an extinguishing gas is initiated as soon as at least one fire characteristic is verified. As already indicated above, there can be a short equipment/system-related delay between the point in time at which a fire characteristic is confirmed and the start of the flooding.

An aspirative fire detection system is particularly suited to detecting fire, same preferably continuously extracting at least one representative sample of air from the enclosed room which is analyzed for the presence of fire characteristics. However, other fire detection elements having mechanically, pneumatically or electrically operative fire detection elements are also conceivable. Fusible link sensors and thermal separation members are cited here as examples of mechanical fire detection elements. A thermocouple is an example of a pneumatic fire detection element. Stem-type temperature sensors are among the examples of electrical fire detection elements.

At least one sensor is preferably provided to detect the oxygen content in the ambient air of the enclosed room, wherein the control unit is designed to set the amount of extinguishing gas introduced into the enclosed room per unit of time at least during the pre-flooding phase as a function of the detected oxygen content. This measure takes proper account of the fact that persons who for example want or need to exit the enclosed room particularly during the pre-flooding phase will open doors or windows such that at least some of the extinguishing gas introduced into the enclosed room during the pre-flooding phase will be wasted. Due to the fact of the control unit being designed to adjust the amount of extinguishing gas introduced into the enclosed room at least during the pre-flooding phase as a function of the oxygen content detected, it can be ensured in a simple to realize yet effective manner that an inerting level corresponding to the predefined or predefinable extinguishing gas concentration is set in the enclosed room as early as the initial interval between the point in time at which the alerting begins and the predefined point in time.

One preferred realization of the inventive solution provides for a first triggering mechanism, by means of which a first extinguishing gas source can be connected to the enclosed room, to be triggered to flood the enclosed room during the pre-flooding phase, and wherein a second triggering mechanism, by means of which a second extinguishing gas source can be connected to the enclosed room additionally to or instead of the first extinguishing gas source, to be triggered to flood the enclosed room during the main flooding phase. This embodiment constitutes a particularly simple to realize yet effective way of putting the inventive method into practice. Particularly possible with this realization is using an extinguishing gas or extinguishing gas mixture during the pre-flooding phase which has a different chemical composition than the extinguishing gas or extinguishing gas mixture introduced into the enclosed room in the main flooding phase.

Extinguishing gas storage tanks such as compressed gas cylinders, for example, in which the necessary reserve amount of extinguishing gas is kept in store, are particularly conceivable sources of extinguishing gas. On the other hand, a nitrogen generator is also conceivable as a source of extinguishing gas, and particularly as the first extinguishing gas source which provides the extinguishing gas introduced during the pre-flooding phase, same providing nitrogen-enriched air at its outlet which can be used as extinguishing gas. In this conceivable realization, it is not necessary to provide additional extinguishing gas storage tanks for storing the extinguishing gas needed for the pre-flooding phase.

Alternatively to the above-specified embodiment, however, it is in principle also conceivable to provide a common source of extinguishing gas which furnishes the extinguishing gas needed for both the pre-flooding phase as well as for the main flooding phase. This common extinguishing gas source is to be connectable to the enclosed room by means of a suitable valve mechanism, wherein the valve mechanism can be controlled such that it can be partly opened during the pre-flooding phase and preferably completely opened during the main flooding phase.

To be understood by the term "triggering mechanism" as used herein is a mechanical, pneumatic or electrical device for triggering the extinguishing gas source and particularly the container and/or sectional valves when compressed gas cylinders, in which the reserve amount of extinguishing gas is kept in store, are used as the source of extinguishing gas. The term "triggering" refers to the opening of the extinguishing gas reserve container valves and the sectional valves—if any—or the actuating of an inert gas generator when same is used as the extinguishing gas source.

With regard to personnel safety, it is fundamentally advantageous for the flooding of the enclosed room with inert gas during the pre-flooding phase to be able to be interrupted or even stopped completely as needed. For example, it is conceivable to provide a stop or an emergency stop button which is connected to the control unit of the fire extinguishing system such that the flooding of the enclosed room during the pre-flooding phase will be interrupted for a predefined period of time or completely stopped when said stop or emergency stop button is pressed. On the other hand, an automatic halting or complete termination of the flooding during the pre-flooding phase is also conceivable, for example when a sensor determines the case of a false alarm or when the flooding of the room is to be discontinued for other reasons.

The following will make reference to the accompanying drawings in describing exemplary embodiments of the present invention.

Shown are:

FIG. 1*a*: the temporal gradient of the extinguishing gas concentration in the enclosed room in a conventional fire extinguishing system in which a time-delayed flooding with advance warning period occurs;

FIG. 1*b*: the temporal gradient of the oxygen concentration in the enclosed room during the flooding gradient shown in FIG. 1*a;*

Figure 2A:
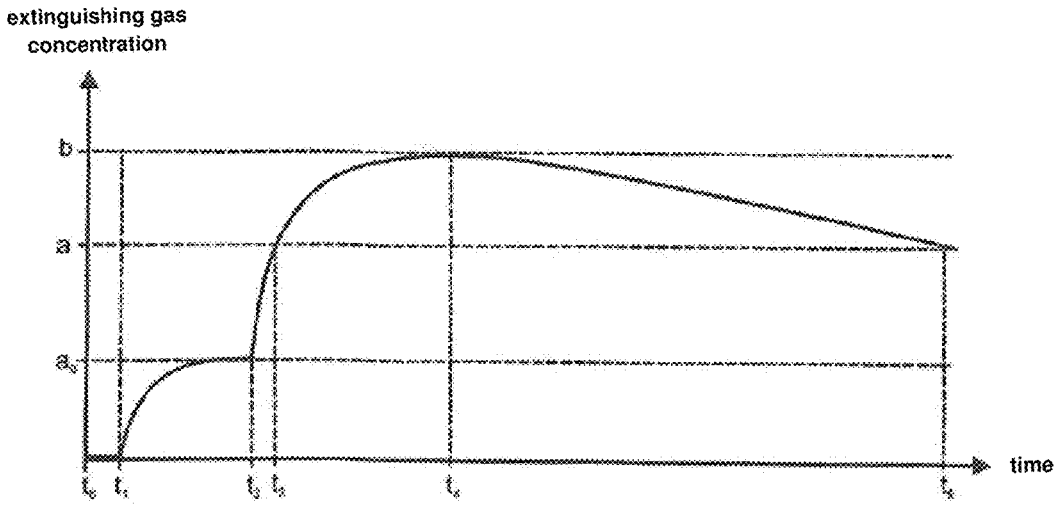
Figure 2B:
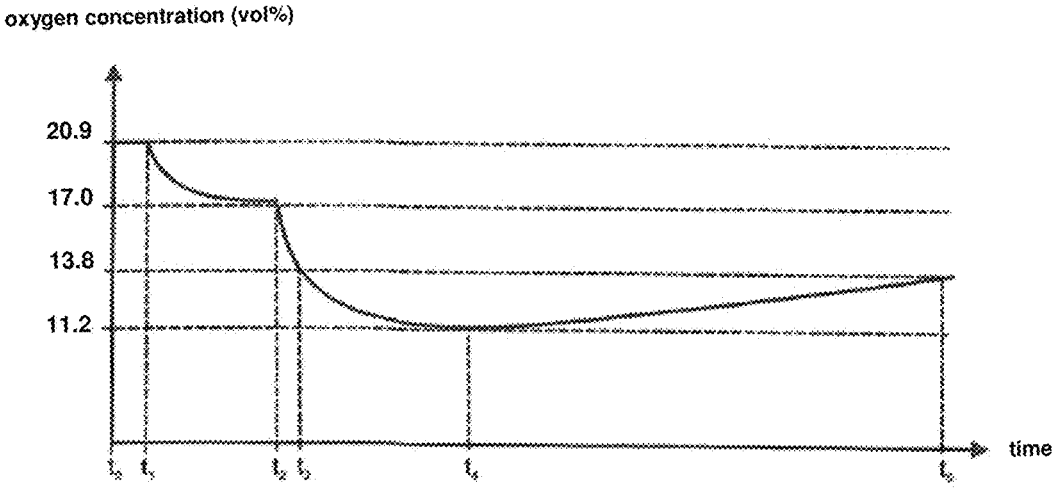

FIG. 2*a*: the temporal gradient of the extinguishing gas concentration in the enclosed room in an exemplary embodiment of the inventive fire extinguishing system in which no time-delayed flooding occurs;

FIG. 2*b*: the temporal gradient of the oxygen concentration in the enclosed room during the flooding depicted in FIG. 2*a;*

Figure 3:
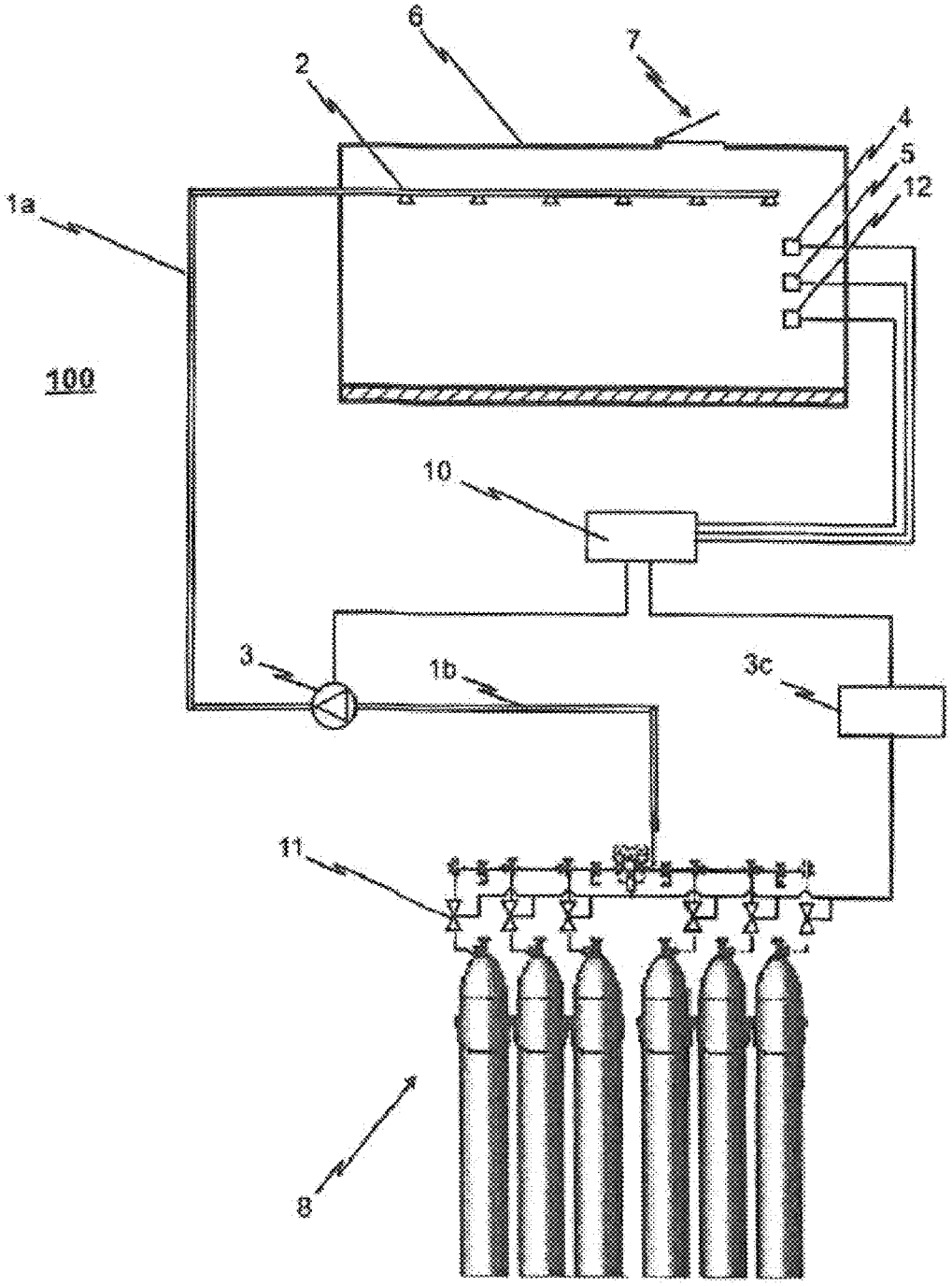
Figure 4:
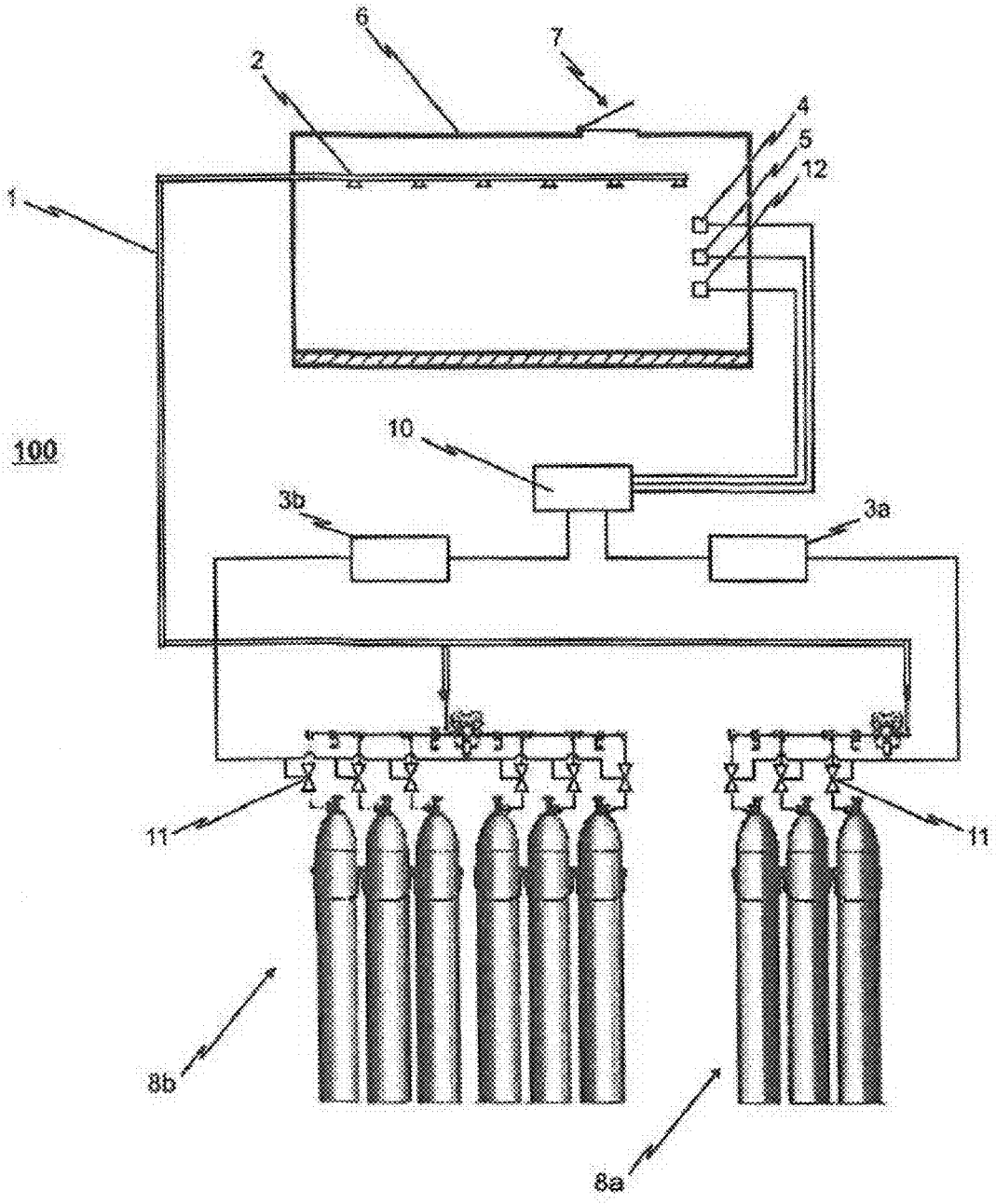
Figure 5:
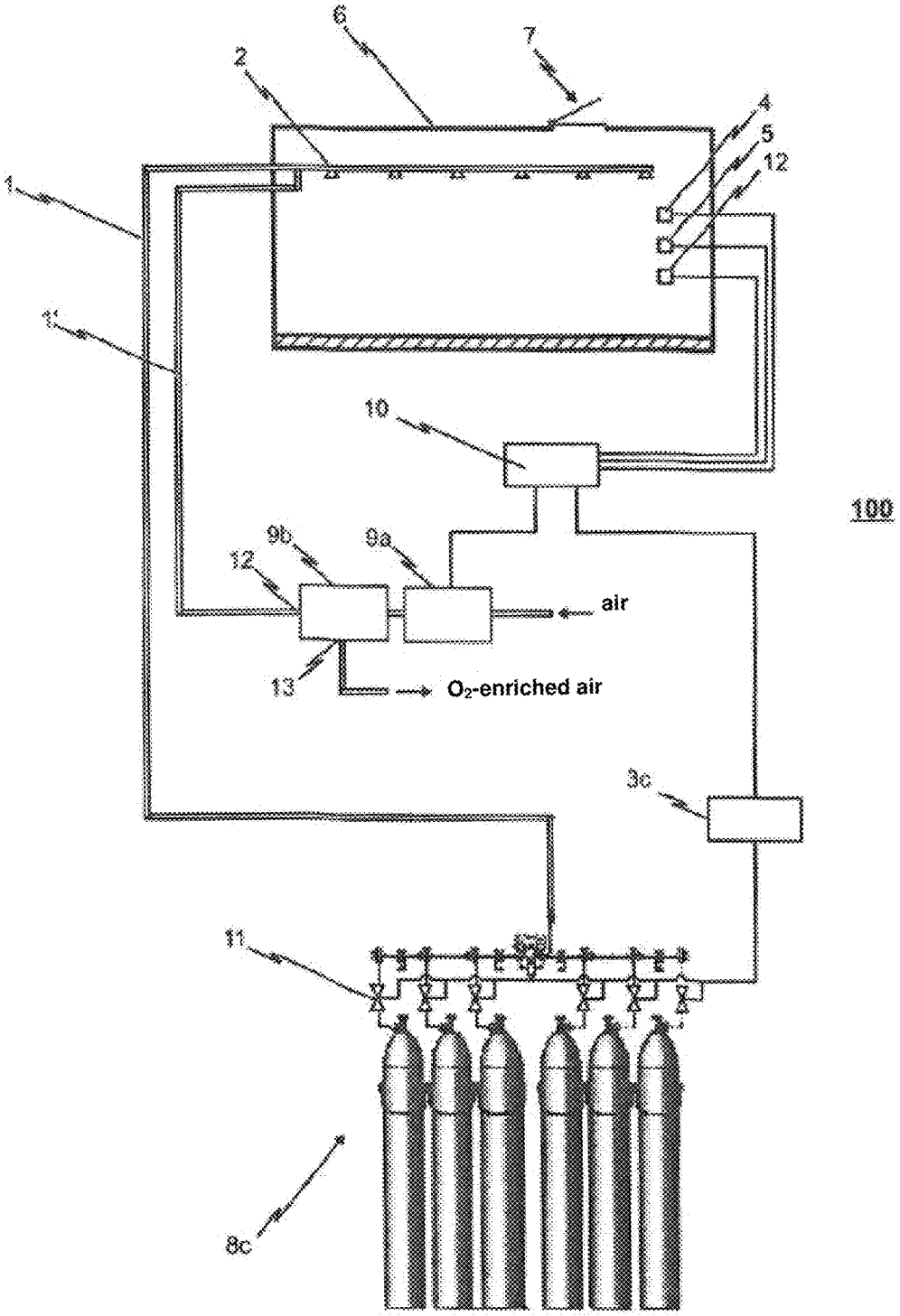
Figure 6:
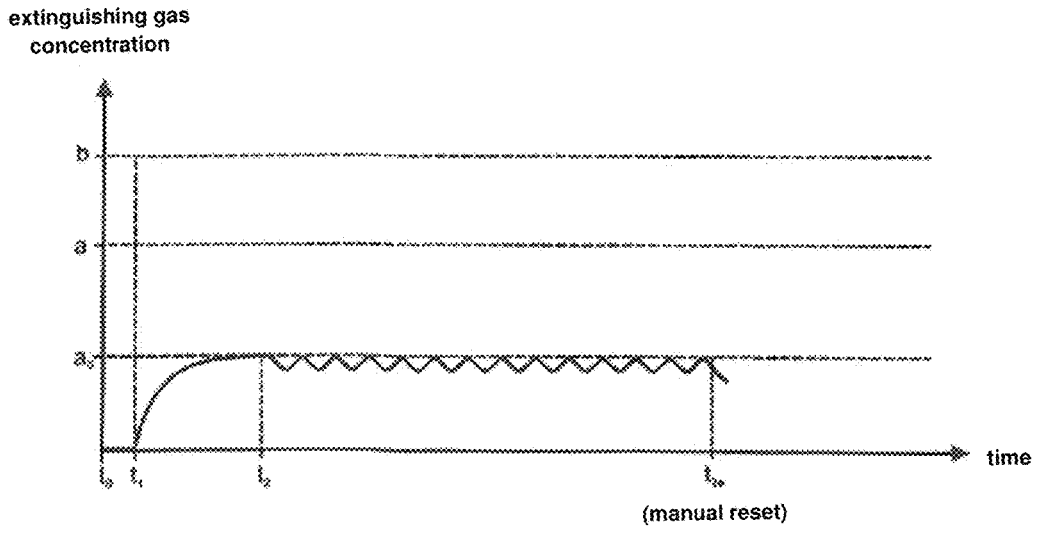
Figure 7:
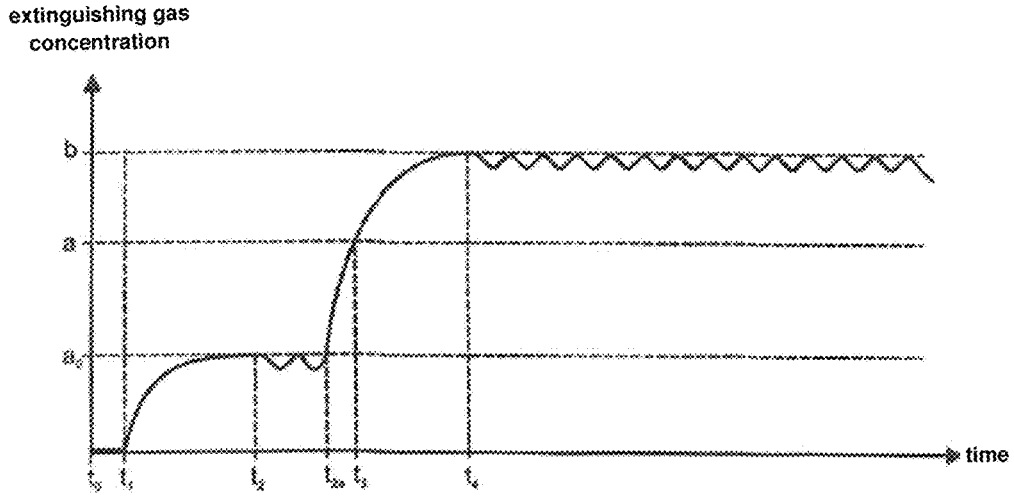
Figure 8:
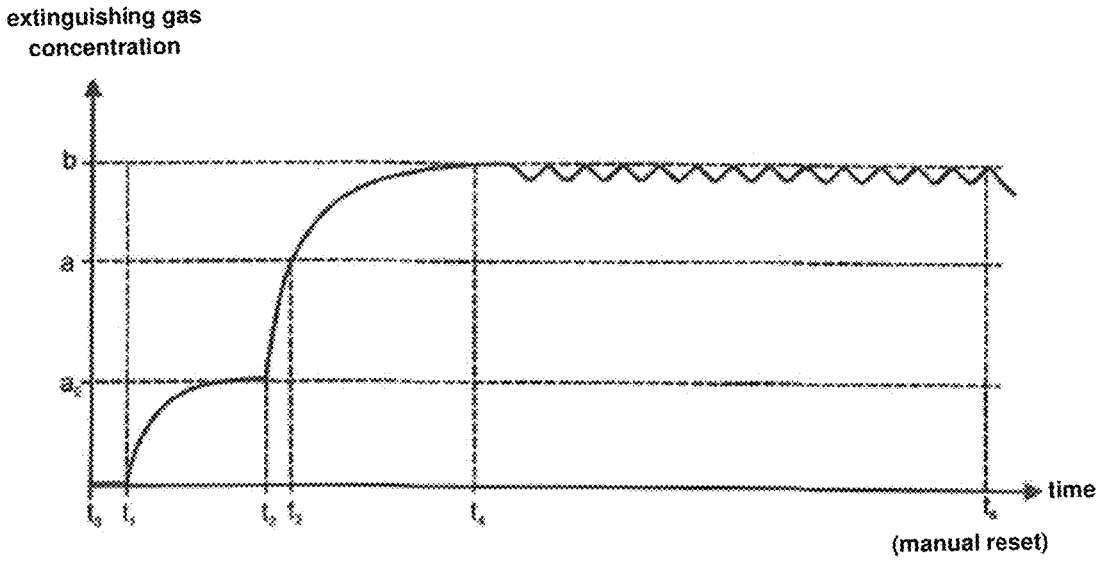

FIG. 3 a schematic view of one embodiment of the fire extinguishing system according to the invention;

FIG. 4 a schematic view of a further embodiment of the fire extinguishing system according to the invention; and FIG. 5 a schematic view of a further embodiment of the fire extinguishing system according to the invention;

FIG. 6 the temporal gradient of the extinguishing gas concentration in the enclosed room according to a further embodiment of the inventive fire extinguishing system with a first sustained flooding phase subsequent the pre-flooding phase;

FIG. 7 the temporal gradient of the extinguishing gas concentration similar to the inventive fire extinguishing system depicted in FIG. 6 with a main flooding phase and subsequent second sustained flooding phase subsequent to the first sustained flooding phase;

FIG. 8 the temporal gradient of the extinguishing gas concentration similar to the FIG. 2*a* depiction with a second sustained flooding phase subsequent the main flooding phase.

FIG. 1*a* shows the flooding gradient of a conventional fire extinguishing system; i.e. the development of the extinguishing gas concentration in the enclosed room in which a time-delayed flooding with advance warning period occurs over time. In detail, FIG. 1*a* depicts the extinguishing gas concentration set in the enclosed room in relation to the time. An IT room serves as the enclosed room in the flooding gradient shown in FIG. 1*a*. FIG. 1*b* shows the development of the oxygen concentration in the enclosed room over time when, as shown in FIG. 1*a*, said room is flooded. $CO_2$ serves as the extinguishing gas in the example shown in FIG. 1*a*.

The $t_0$ time indicates the point in time at which a fire detection device responds or respectively the point in time of a manual trigger being activated if same is provided. Due to equipment/system-related contingencies, the responding of an alarm mechanism to warn personnel within the extinguishing/hazard zone at time $t_1$ normally follows with a slight delay compared to the responding of the fire detection device at time $t_0$. Since fire extinguishing systems with which persons can be endangered by a flooding of the extinguishing zone must be equipped with delay mechanisms, a delayed flooding with advance warning period occurs in the flooding gradient shown in FIG. 1*a*. Specifically, the interval between time $t_1$ (alarm mechanism response) and time $t_2$ (gaseous extinguishing agent release) indicates the advance warning period to be provided for personnel safety reasons which needs to be calculated such that any given point within the extinguishing zone, the enclosed room respectively, can be exited without haste. According to the VdS 3518 Guidelines (July 2006) or the BGI 888 (January 2004), this advance warning period must be at least 10 seconds.

Therefore, the accumulative flooding in the example known from the prior art shown in FIG. 1*a* does not start until time $t_2$ since the gaseous extinguishing agent is not allowed to be released until this point in time. As can be noted from the FIG. 1*a* depiction, the extinguishing agent concentration increases relatively rapidly as of time $t_2$ and reaches maximum extinguishing gas concentration b at time $t_4$. An extinguishing gas concentration capable of providing an extinguishing effect a is already present at time $t_3$. The $t_2$-$t_3$ interval is identified as the period for building up the extinguishing gas concentration capable of providing an extinguishing effect and the $t_2$-$t_4$ interval is identified as the accumulative flooding period. Maximum extinguishing gas concentration b is reached at time $t_4$. This point in time thus marks the end of the accumulative flooding. Since no sustained flooding is provided for in the flooding gradient depicted in FIG. 1*a*, the extinguishing gas concentration continuously decreases as of time $t_4$, which is attributable to leakages in spatial shell of the enclosed room. In consequence thereof, the extinguishing gas concentration capable of providing an extinguishing effect a is undershot at time $t_6$. The interval between time $t_4$ (end of accumulative flooding) and time $t_6$ (falling below the extinguishing gas concentration capable of providing an extinguishing effect) should be long enough so that material within the enclosed room cools down sufficiently and reigniting can be prevented.

It is to be kept in mind that according to the VdS Guidelines, the extinguishing gas concentration capable of providing an extinguishing effect a must be reached within 10, 60 or 120 seconds after the extinguishing agent has been released. Particularly in the case of rooms which enclose a large volume, such as for example high-bay storage facilities, etc. this requirement can only be met at relatively high expenditure. Conventional fire extinguishing systems must in particular be dimensioned such that they are able to introduce the necessary amount of extinguishing gas into the enclosed room so as to reach the concen-tration capable of providing an extinguishing effect a within delayed interval $t_2$-$t_3$.

FIG. 1*b* depicts the temporal gradient of the oxygen concentration in the enclosed room (here: IT room) when, as shown in FIG. 1*a*, the enclosed room is flooded.

According thereto, the oxygen concentration in the enclosed room is at a constant value (20.9 vol %) up until time $t_2$, this value corresponding to the average ambient air oxygen content. Since accumulative flooding does not occur until time $t_2$ according to the FIG. 1*a* representation, the oxygen concentration drops relatively rapidly in the FIG. 1*b* representation only as of this point in time and reaches a minimum value of 11.2 vol % at time $t_4$. Since the flooding gradient depicted in FIG. 1*a* does not provide for any sustained flooding, the oxygen concentration continuously increases as of time $t_4$ as ambient air infiltrates through leakages in the spatial shell of the enclosed room.

The following will make reference to the representations provided in FIGS. 2*a* and 2*b*. FIG. 2*a* thereby shows the flooding gradient; i.e. the development of the extinguishing gas concentration in the spatial atmosphere of the enclosed room over time with a fire extinguishing system according to an exemplary embodiment of the inventive solution. FIG. 2*b* depicts the corresponding temporal development of the oxygen concentration in the spatial atmosphere of the enclosed room. The $t_0$, $t_1$, $t_2$, $t_3$, $t_4$, $t_5$ and $t_6$ time points indicated on the time axis (x-axis) are accorded the same meaning as the corresponding time points in FIG. 1*a*. The y-axis, which in FIG. 2*a* illustrates the extinguishing gas concentration in the spatial atmosphere of the enclosed room, depicts the extinguishing gas concentration capable of providing an extinguishing effect as "a" and the maximum extinguishing gas concentration as "b." As previously stated, the value of the extinguishing gas concentration capable of providing an extinguishing effect a depends on the fire load of the materials within the enclosed room. Such a characteristic extinguishing gas concentration capable of providing an extinguishing effect a for the enclosed room is called the "design concentration" in the fire technology field.

In contrast to the flooding gradient depicted FIG. 1*a*, no time-delayed flooding occurs according to the teaching of the present invention. Instead, extinguishing gas is already being introduced into the enclosed room at time $t_1$ (alarm mechanism response). The extinguishing gas concentration in the spatial atmosphere of the enclosed room insofar already starts rising at time $t_1$. However, in order to be able to exclude risk to any people who may be in the enclosed room at the start of flooding (time $t_1$), it is inventively provided for the extinguishing gas concentration of the extinguishing gas employed not to exceed a predefined or predefinable value $a_0$ during an advance warning period which ends at time $t_2$. This predefined or predefinable limit value $a_0$ may not exceed the critical NOAEL value for the extinguishing gas employed and is preferably below said NOAEL value.

The limit value $a_0$ is in particularly dependent on the fire load of the enclosed room 6; i.e. is to be definable or predefined as a function of the fire load of the enclosed room. In order to minimize the time for building up the extinguishing gas concentration capable of providing an extinguishing effect a, is it advantageous according to the inventive method for the predefined or predefinable limit value $a_0$ to be established no later than time $t_2$, at which the advance warning period ends.

As is also the case with conventional fire extinguishing systems, an acoustic and/or if needed visual alarm occurs in the inventive solution as of time $t_1$ so as to warn any people there may be within the extinguishing zone. The advance warning period, which corresponds to the $t_1$-$t_2$ interval, is calculated such that the extinguishing zone; i.e. the enclosed room, can be exited from any given spot so as to ensure the evacuation of the enclosed room at time $t_2$.

In order not to waste any time, the point in time at which the acoustic and/or if needed visual alerting is triggered corresponds to time $t_1$ as of which the extinguishing gas is introduced into the enclosed room 6 in the course of the pre-flooding phase. The entire time interval $t_2$-$t_1$ or $t_2$-$t_0$ respectively is thereby avail-able to order to able to ensure the evacuation of personnel from enclosed room 6.

Comparing the flooding gradients of FIG. 1*a* and FIG. 2*a* shows that a specific extinguishing gas level is already set at time $t_2$ in the inventive solution. This extinguishing gas level at time $t_2$ corresponds to an extinguishing gas concentration $a_0$ in the enclosed room below the critical NOAEL concentration for the extinguishing gas employed. Because a specific extinguishing gas level $a_0$ has already been established in the enclosed room at time $t_2$ (end of the advance warning period) in the flooding gradient according to FIG. 2*a*, the amount of extinguishing gas introduced into the enclosed room per unit of time needed to reach the maximum extinguishing gas concentration b at time $t_4$ can be reduced in comparison to conventional solutions known from the prior art. This becomes apparent in the FIG. 2*a* representation by the fact of there being a lesser inclination to the flooding curve over the $t_2$-$t_4$ interval (flooding period of the accumulative flooding) compared to the gradient of the flooding curve depicted in FIG. 1*a*. The inventive solution thus enables a more temperate flooding of the enclosed room compared to the prior art, in consequence of which the pressure relief areas to be provided can be of smaller dimension.

The $t_1$-$t_2$ interval; i.e. the time between the alarm mechanism response and the end of the advance warning period, is thus used according to the inventive solution to initially flood the extinguishing zone. The $t_1$-$t_2$ interval is also referred to herein as the "pre-flooding phase." The so-called main flooding phase, corresponding to the $t_2$-$t_4$ interval, immediately follows the pre-flooding phase. In the flooding gradient shown in FIG. 1*a*, this interval corresponds to the total flooding time provided for the accumulative flooding.

FIG. 2*a* depicts a flooding gradient which can be realized with an exemplary embodiment of the inventive fire extinguishing system. In the FIG. 2*a* flooding gradient, the amount of extinguishing gas introduced into the enclosed room per unit of time during the pre-flooding phase ($t_1$-$t_2$ interval) is just the same as the amount of extinguishing gas introduced into the enclosed room per unit of time during the main flooding phase ($t_2$-$t_4$ interval). This can then be realized when it is ensured that the extinguishing gas concentration capable of providing an extinguishing effect a is reached within the prescribed time interval after the fire extinguishing system being activated. Pursuant the VdS Guidelines, this interval is 60 or 120 seconds.

In order to fundamentally ensure that the extinguishing gas concentration capable of providing an extinguishing effect a is reached within the predefined $t_0$-$t_3$ interval, it is necessary as applicable for the amount of extinguishing gas introduced into the enclosed room per unit of time during the main flooding phase ($t_2$-$t_4$ interval) to be greater than the amount of extinguishing gas introduced into the enclosed room per unit of time during the pre-flooding phase ($t_1$-$t_2$ interval).

The following will reference the FIG. 3 representation in describing a feasible embodiment of the inventive fire extinguishing system 100. In the embodiment according to FIG. 3, the inventive fire extinguishing system 100 is used as a stationary area protection system and serves to protect all the contents of the room identified by reference numeral "6." Said room 6 is an enclosed room such as, for example, a high-bay storage facility, IT room or a switching/distribution cabinet.

The fire extinguishing system 100 according to the schematic representation of FIG. 3 comprises an extinguishing gas source 8 for supplying an extinguishing gas. Used as the extinguishing gas source 8 in the embodiment depicted in FIG. 3 is a battery of compressed gas cylinders which keeps in store the amount of extinguishing gas required for both the pre-flooding phase as well as also the main flooding phase and, if applicable, also the sustained flooding phase.

The individual compressed gas cylinders of extinguishing gas source 8 can be connected by means of valves 11 to a pipeline system 1*a*, 1*b* which is in turn connected to nozzles 2 appropriately distributed within the enclosed room 6. In the event of a fire, the compressed gas cylinder tank valves 11 are opened so that the extinguishing gas provided in the compressed gas cylinders can be fed into the enclosed room 6 via the pipeline system 1*a*, 1*b* and nozzles 2.

The individual compressed gas cylinder tank valves 11 can preferably be triggered automatically by means of a control unit 10. The (selectively) automatic triggering can ensue by means of mechanical, pneumatic or electrical systems and/or a combination of the aforementioned possibilities.

The flooding of the enclosed room 6 with extinguishing gas is initiated by the control unit 10 at time $t_1$ as soon as a fire sensor 4 provided in the enclosed room 6 signals the control unit 10 of the presence of at least one fire characteristic in the ambient air of enclosed room 6.

So that the extinguishing gas concentration in the enclosed room 6 will not exceed the predefined or predefinable value $a_0$ for the extinguishing gas employed during the pre-flooding phase, the embodiment depicted in FIG. 3 makes use of a regulating valve 3 able to be controlled by the control unit 10. Specifically, this regulating valve 3 divides the pipeline system 1*a*, 1*b* by means of which the extinguishing gas source 8 is connected to the nozzles 2 into a first section 1*a* and a second section 1*b*. These two pipeline sections 1*a*, 1*b* are connectable via the regulating valve 3.

The control unit 10 in the embodiment of the inventive fire extinguishing system 100 depicted in FIG. 3 is designed so as to control the valve mechanism 3 such that it is only partly open during the pre-flooding phase and completely open during the main flooding phase. Specifically, the control unit 10 controls the valve mechanism 3 during the pre-flooding phase such that the concentration of extinguishing gas in the enclosed room 6 does not exceed the predefined critical concentration value $a_0$ during the pre-flooding phase.

As can be further seen from the FIG. 3 representation, the inventive fire extinguishing system 100 preferably comprises a visual and/or acoustic alarm mechanism 5. This alarm mechanism 5 serves to warn any people who may be inside the enclosed room 6. To this end, the alarm mechanism 5 is connected to the control unit 10, whereby the control unit 10 immediately activates the alarm mechanism 5 as soon as the fire sensor 4 notifies the control unit 10 of the presence of at least one fire characteristic in the ambient air of enclosed room 6. Alternatively or additionally hereto, it is also conceivable for the control unit 10 to trigger the alarm mechanism 5 when the fire extinguishing system 100 has been manually triggered, for example by the actuating of a manual trigger.

At least one sensor 12 is further provided for detecting the oxygen content in the spatial atmosphere of the enclosed room 6. The control unit 10 receives the values detected by the oxygen sensor 12 continuously or at predetermined times or upon predetermined events and regulates the amount of extinguishing gas supplied to the enclosed room 6 per unit of time as a function of the detected oxygen content, at least during the pre-flooding phase.

As can be further noted from the FIG. 3 representation, a pressure relief flap 7 is provided in the spatial shell of the enclosed room 6. This pressure relief flap 7 serves to prevent damage to the room 6 due to high excess pressure when the enclosed room 6 is flooded in response to a fire.

The following will reference the FIG. 4 representation in describing a further embodiment of the inventive fire extinguishing system 100. The fire extinguishing system 100 depicted in FIG. 4 substantially corresponds to the system described above with reference to the FIG. 3 representation, whereby however an alternative solution is used to keep ready the amount of extinguishing gas necessary for flooding the enclosed room 6.

In detail, the embodiment of the inventive fire extinguishing system 100 schematically depicted in FIG. 4 provides for a first extinguishing gas source 8*a* in which the amount of extinguishing gas needed for the pre-flooding phase is held and a second extinguishing gas source 8*b* in which the amount of extinguishing gas needed for the main flooding phase is held. Since the amount of extinguishing gas needed for the pre-flooding phase is usually less than the amount of extinguishing gas needed for the main flooding phase, the first extinguishing gas source 8*a* can be—as FIG. 4 indicates—of smaller dimensions than the second extinguishing gas source 8*b*. In the embodiment of the inventive fire extinguishing system 100 depicted in FIG. 4, respective batteries of compressed gas cylinders are used for the first and second extinguishing gas sources 8*a*, 8*b*.

In the event of fire, or when the fire extinguishing system 100 is activated respectively, the control unit 10 actuates a first triggering mechanism 3*a* at time $t_1$. This first triggering mechanism 3*a* serves to mechanically, pneumatically or electrically open the respective tank valves 11 of the individual compressed gas cylinders of the first extinguishing gas source 8*a* so that the amount of extinguishing gas kept in store in the first extinguishing gas source 8*a* can be fed into the enclosed room 6 via the pipeline system 1 and nozzles 2. At time $t_2$; i.e. after the advance warning period has ended, or at the end of the pre-flood phase respectively, the control unit 10 actuates a second triggering mechanism 3*b* which opens the respective tank valves 11 of the individual compressed gas cylinders of the second extinguishing gas source 8*b* so that the amount of extinguishing gas kept in store by the second extinguishing gas source 8*b* can be fed into the enclosed room 6 via the pipeline system 1 and nozzles 2. The control unit 10 is thereby designed such that the time $t_2$, at which the second triggering mechanism 3*b* is activated and the second extinguishing gas source 8*b* triggered, can be predefined.

The following will reference the FIG. 5 representation in describing a further embodiment of the inventive fire extinguishing system 100. This embodiment differs from the systems schematically depicted above with reference to the FIGS. 4 and 5 representations by an alternative realization of the extinguishing gas sources which supply the extinguishing gas needed to flood the enclosed room 6.

In detail, an inert gas generator is provided in the embodiment of the inventive fire extinguishing system 100 depicted in FIG. 5. Same comprises a compressor 9*a* and a downstream filtering device 9*b*, particularly a membrane filter device. The compressor 9*a* compresses ambient air which is thereafter fed to the filtering device 9*b*. A gas separation occurs in the filtering device 9*b* such that nitrogen-enriched air is yielded at one outlet 12 of the filtering device 9*b* of the inert gas generator and oxygen-enriched air is yielded at another outlet 13 of the filtering device 9*b* of the inert gas generator. In the embodiment depicted in FIG. 5, the nitrogen-enriched air serves as the extinguishing gas supplied to the enclosed room 6 during the pre-flooding phase. For this purpose, the corresponding outlet 12 of the filtering device 9*b* of the inert gas generator is connected to the enclosed room 6 by means of a pipeline system 1 and nozzles 2.

In the event of fire, or when the fire extinguishing system 100 is actuated respectively, the control unit 10 activates the inert gas generator, and particularly compressor 9*a*, at time $t_1$. In consequence thereof, the inert gas generator provides nitrogen-enriched air which is supplied to the enclosed room 6 by a pipeline system 1' allocated to the inert gas generator or by pipeline system 1 if applicable. The amount of nitrogen-enriched air supplied per unit of time during the pre-flooding phase can be regulated by control unit 10, for example by accordingly varying the output of compressor 9*a*.

On the other hand, the extinguishing gas needed for the main flooding phase is provided by a further extinguishing gas source 8*c*. This further extinguishing gas source 8*c* is again realized as a battery of compressed gas cylinders in the embodiment of the inventive fire extinguishing system 100 depicted in FIG. 5. Moreover provided is a triggering mechanism 3*c* allocated to the further extinguishing gas source 8*c*. The control unit 10 can open the respective tank valves 11 of the individual compressed gas cylinders of the further extinguishing gas source 8*c* by means of this triggering mechanism 3*c*, this occurring at time $t_2$; i.e. subsequent to the pre-flooding phase and at the end of the advance warning period. The extinguishing gas kept in store by the further extinguishing gas source 8*c* during the main flooding phase then flows through the pipeline system 1 to the nozzles 2 and from there into the enclosed room 6.

FIG. 6 yields a further flooding gradient which is similar to the FIG. 2*a* flooding gradient up until the predefined time ($t_2$) constituting the end of the pre-flooding phase. In the FIG. 6 embodiment, a first sustained flooding phase (interval $t_2$-$t_{2a}$) follows the pre-flooding phase (interval $t_1$-$t_2$) during which the concentration of extinguishing gas in the enclosed room 6 is kept at predefined or predefinable value $a_0$. Thus, potential flare-ups due to the oxygen concentration increasing again in the enclosed room 6 in the absence of the first sustained flooding phase is effectively prevented or such a risk of re-ignition is considerably reduced during this first sustained flooding phase from time $t_2$ to time $t_2$ to time $t_{2a}$, particularly in the case of fire being present prior to the first sustained flooding phase; i.e. during the pre-flooding phase.

The flooding gradient pursuant to FIG. 6 hereby represents the case of no fire being determined within the enclosed room when the status of enclosed room 6 is checked. It is particularly conceivable here for a manual resetting to occur at $t_{2a}$; i.e. that the end of the first sustained flooding phase occurs at time $t_{2a}$ by the manual actuating of a corresponding apparatus, for example a button. Subsequent to $t_{2a}$, which marks the end of the first sustained flooding phase, the supply of extinguishing gas therefore stops such that the concentration of extinguishing gas decreases again as time continues.

In contrast thereto, it is evident from the FIG. 7 flooding gradient that a main flooding phase (interval $t_{2a}$-$t_4$) follows the first sustained flooding phase also provided here. Similar to that as previously stated in conjunction with the FIG. 2*a* flooding gradient, an effective extinguishing gas concentration a is reached at time $t_3$ during the main flooding phase. After time $t_3$, extinguishing gas continues to be supplied during the main flooding phase until maximum extinguishing gas concentration b is reached. In contrast to the embodiment depicted in FIG. 2*a*, however, a second sustained flooding phase now follows at time $t_4$, during which extinguishing gas is further fed into the enclosed room 6 in regulated manner such that the extinguishing gas concentration capable of providing an extinguishing effect in dependence on the fire load of the enclosed room 6 is not exceeded over the course of the entire second sustained flooding phase (interval $t_4$-$t_6$). The $t_4$-$t_6$ interval which denotes the second sustained flooding phase is hereby selected for example such that the materials within the enclosed room will cool down and thus renewed combustion (reigniting) during this period be effectively prevented. In this context, compared to the embodiment from FIG. 2*a*, the fact that unknown possibly large leakages from enclosed room 6 will not contribute to reducing the interval of time between the end of the accumulative flooding and the time at which the extinguishing gas concentration capable of providing an extinguishing effect is undershot after the main flooding phase to the extent of not being able to effectively prevent such re-ignition is hereby particularly advantageous.

Lastly, FIG. 8 shows an exemplary flooding gradient in which a second sustained flooding phase (interval $t_4$-$t_6$) is likewise provided subsequent to the main flooding phase. In contrast to the embodiment according to FIG. 7, however, no first sustained flooding phase is provided here. In other words, the main flooding phase directly follows the pre-flooding phase in the flooding gradient according to the FIG. 8 embodiment. The main flooding phase is in turn directly followed by the second sustained flooding phase, during which the extinguishing gas concentration in the enclosed room is always kept above the extinguishing gas concentration capable of providing an extinguishing effect by the regulated post-feeding of extinguishing gas. This embodiment thus corresponds to a situation in which the checking of the enclosed room's status yields the fact that a fire which broke out in the enclosed room 6 has not been suppressed or not sufficiently suppressed following the end of the pre-flooding phase and thus a main flooding phase is to proceed immediately after the pre-flooding phase so as to reach the extinguishing gas concentration capable of providing an extinguishing effect a as quickly as possible. It is hereby in turn conceivable for time $t_6$, which marks the end of the second sustained flooding phase, to be either predefined or manually defined at a later point in time. A manual defining at a later point in time thus corresponds to a manual reset which can occur upon determining, for example by manual verification, that a fire which broke out in the enclosed room 6 has not been suppressed or not sufficiently suppressed following the end of the pre-flooding phase.

The solution according to the invention is not limited to the embodiments of the fire extinguishing system 100 depicted as examples in the figures. It is particularly conceivable for the control unit 10 to regulate the entire flooding gradient such that the enclosed room 6 is flooded according to a predefined sequence of events.

LIST OF REFERENCE NUMERALS

1 pipeline system
1' pipeline system (nitrogen generator)
1*a*, 1*b* first/second pipeline section
2 nozzles
3 regulating valve
3*a* first triggering mechanism for first extinguishing gas source 8*a*
3*b* second triggering mechanism for second extinguishing gas source 8*a*
3*c* triggering mechanism for further extinguishing gas source 8*c*
4 fire sensor
5 alarm mechanism
6 enclosed room/flood zone
7 pressure relief flap
8 common extinguishing gas source
8*a* first extinguishing gas source
8*b* second extinguishing gas source
8*c* further extinguishing gas source
9*a* nitrogen generator compressor
9*b* nitrogen generator filtering device
10 control unit
11 tank valve
12 oxygen sensor
100 fire extinguishing system

What is claimed is:

1. A method for extinguishing fire in an enclosed room, the method comprising:

i) triggering a visual and/or acoustic alarm mechanism to warn any persons who might be within the enclosed room;

ii) initiating a release of extinguishing agent such that the enclosed room will be supplied an extinguishing gas until an extinguishing gas concentration capable of providing an extinguishing effect is set, and iii) monitoring a status of the enclosed room, wherein the release being a flooding of the enclosed room that is divided into a pre-flooding phase and a main flooding phase subsequent thereto, wherein the pre-flooding phase corresponds to a first interval of time between a first time the visual and/or acoustic alarm starts and a first predefined time and the main flooding phase corresponds to a second interval of time between the first predefined time and a second time at which a maximum extinguishing gas concentration is reached, the enclosed room being flooded such that the extinguishing gas concentration in the enclosed room over the entire pre-flooding phase does not exceed a predefined or predefinable value for the extinguishing gas employed which is below a critical no-observed-adverse-effect level (NOAEL) value for the extinguishing gas as employed, wherein the first predefined time is selected such that any persons who may be within the enclosed room can exit said enclosed room during the pre-flooding phase, wherein the extinguishing gas concentration in the enclosed room is maintained at the predefined or predefinable value after the pre-flooding phase ends during a first sustained flooding phase if it is determined, by a fire detector or manually, that the fire is not present in the enclosed room after the pre-flooding phase ends, wherein the first sustained flooding phase corresponds to a third interval of time between the time at which the pre-flooding phase ends and a third predefined time or a first manually definable time, and wherein the maximum extinguishing concentration is reached in the enclosed room during the main flooding phase corresponding to the second interval of time between the first predefined time and the second time if it is determined, by the fire detector or manually, that the fire is present in the enclosed room after the pre-flooding phase ends.

2. The method according to claim 1, wherein the predefinable value is selected such that the pre-flooding phase is at least 10 seconds.

3. The method according to claim 1, wherein the enclosed room is flooded in procedural step ii) such that, at the latest at the predefined time, the extinguishing gas concentration in the enclosed room is at a particular predefined or definable value which is dependent on a fire load of the enclosed room.

4. The method according to claim 1, wherein the time at which the extinguishing agent is released in procedural step ii) coincides with the time at which the visual and/or acoustic alarm mechanism is triggered in procedural step i).

5. The method according to claim 1, wherein after the main flooding phase ends, maintaining the extinguishing gas concentration in the enclosed room such that during a second sustained flooding phase, the extinguishing gas concentration does not fall below the extinguishing gas concentration capable of providing the extinguishing effect dependent on a fire load of the enclosed room, wherein the second sustained flooding phase corresponds to fourth interval of time between the time at which the main flooding phase ends and a fourth predefined time or a second manually definable time.

6. The method according to claim 1, wherein the predefined or predefinable value for the extinguishing gas concentration with respect to the extinguishing gas employed corresponds to an oxygen concentration which still allows unrestricted personnel accessibility to the enclosed room.

7. The method according to claim 1, wherein the enclosed room is monitored preferably continuously or at predetermined times or upon predetermined events with respect to presence of at least one fire characteristic, and wherein procedural steps i) to iii) are automatically initiated as soon as the at least one fire characteristic is detected.

8. The method according to claim 1, wherein the flooding of the enclosed room during the pre-flooding phase can be interrupted for a predefined period or completely stopped by actuating of a stop or emergency stop button.

9. A method for extinguishing fire in an enclosed room, the method comprising:

i) triggering a visual and/or acoustic alarm mechanism to warn any persons who might be within the enclosed room;

ii) initiating a release of extinguishing agent such that the enclosed room will be supplied an extinguishing gas until an extinguishing gas concentration capable of providing an extinguishing effect is set, and iii) monitoring a status of the enclosed room, wherein monitoring includes:

activating an alarm mechanism in response to a sensor indicating presence of at least one fire characteristic in ambient air of the enclosed room or based on a manual trigger, providing, in response to the alarm mechanism, the extinguishing gas in the enclosed room during a pre-flooding phase to increase the concentration of the extinguishing gas in the enclosed room to reach and not exceed a predefined value for the extinguishing gas which is below a critical non-observed-adverse-effect level (NOAEFL) value for the extinguishing gas, determining, by a fire detector or manually, whether the fire is present in the enclosed room after the pre-flooding phase ends, in response to determining that the fire is not present in the enclosed room after the pre-flooding phase ends, maintaining the concentration of the extinguishing gas in the enclosed room at the predefined value during a sustained flooding phase for a selected amount of time after the pre-flooding phase, and in response to determining that the fire is present in the enclosed room after the pre-flooding phase ends, adding an additional amount of extinguishing gas in the enclosed room during a main flooding phase and after the pre-flooding phase to increase the concentration of the extinguishing gas in the enclosed room to reach a maximum extinguishing gas concentration.

10. A method for extinguishing fire in an enclosed room, the method comprising:

i) triggering a visual and/or acoustic alarm mechanism to warn any persons who might be within the enclosed room;

ii) initiating a release of extinguishing agent such that the enclosed room will be supplied an extinguishing gas until an extinguishing gas concentration capable of providing an extinguishing effect is set, and iii) monitoring the status of the enclosed room, wherein the release being a flooding of the enclosed room is divided into a pre-flooding phase and a main flooding phase subsequent thereto, wherein the pre-flooding phase corresponds to a first interval of time between a first time the visual and/or acoustic alarm starts and a first predefined time and the main flooding phase corresponds to a second interval of time between the first predefined time and a second time at which a maximum extinguishing gas concentration is reached, the enclosed room being flooded such that the extinguishing gas concentration in the enclosed room over the entire pre-flooding phase does not exceed a predefined or predefinable value for the extinguishing gas employed which is below a critical no-observed-adverse-effect level (NOAEL) value for the extinguishing gas as employed, wherein up to the first time, where the visual and/or acoustic alarm starts and where the pre-flooding phase starts, an oxygen concentration in the enclosed room corresponds to an oxygen concentration of ambient air, wherein the first predefined time is selected such that any persons who may be within the enclosed room can exit said enclosed room during the pre-flooding phase, and wherein the extinguishing gas concentration in the enclosed room is: (1) maintained at the predefined or predefinable value after the pre-flooding phase ends during a first sustained flooding phase, wherein the first sustained flooding phase corresponds to a third interval of time between the time at which the pre-flooding phase ends and a third predefined time or a first manually definable time, and (2) increased to maximum extinguishing gas concentration to begin the main flooding period after the pre-flooding phase ends.

* * * * *